US007570226B2

(12) United States Patent
Bassily

(10) Patent No.: US 7,570,226 B2
(45) Date of Patent: Aug. 4, 2009

(54) METHOD AND APPARATUS FOR GRATING LOBE CONTROL IN FACETED MESH REFLECTORS

(75) Inventor: Samir F. Bassily, Los Angeles, CA (US)

(73) Assignee: The Boeing Company, Chicago, IL (US)

( * ) Notice: Subject to any disclaimer, the term of this patent is extended or adjusted under 35 U.S.C. 154(b) by 82 days.

(21) Appl. No.: 11/365,389

(22) Filed: Feb. 28, 2006

(65) Prior Publication Data

US 2007/0200790 A1 Aug. 30, 2007

(51) Int. Cl.
*H01Q 15/20* (2006.01)

(52) U.S. Cl. ..... 343/912; 343/915

(58) Field of Classification Search ..... 343/912, 343/915, 916, 840

See application file for complete search history.

(56) References Cited

U.S. PATENT DOCUMENTS

| | | | | |
|---|---|---|---|---|
| 3,286,270 | A * | 11/1966 | Kelly | 343/915 |
| 4,528,569 | A * | 7/1985 | Felter et al. | 343/840 |
| 5,440,320 | A | 8/1995 | Lach et al. | |
| 5,680,145 | A | 10/1997 | Thomson et al. | |
| 5,963,182 | A | 10/1999 | Bassily | |
| 5,969,695 | A | 10/1999 | Bassily et al. | |
| 5,996,940 | A | 12/1999 | McVey et al. | |
| 6,028,569 | A | 2/2000 | Bassily et al. | |
| 6,030,007 | A | 2/2000 | Bassily et al. | |
| 6,214,144 | B1 | 4/2001 | Bassily et al. | |
| 6,321,503 | B1 | 11/2001 | Warren | |
| 6,374,565 | B1 | 4/2002 | Warren | |
| 6,384,800 | B1 | 5/2002 | Bassily et al. | |
| 2005/0104798 | A1 | 5/2005 | Nolan et al. | |

FOREIGN PATENT DOCUMENTS

| | | | |
|---|---|---|---|
| JP | 05024592 | A | 2/1993 |
| JP | 2006 246243 | A | 9/2006 |

OTHER PUBLICATIONS

Thomas, Mark W., "Astromesh™ Deployable Reflectors for KU- And KA-Band Commercial Satellites," 2002, pp. 1-9, *American Institute of Aeronautics and Astronautics*.

Orikasa, T et al: "Sidelobe Suppression of Mesh Reflector Antenna by Non-Regular Intervals". Anntennas and Propagation Society International Symposium 1993, AP-S. Digest Ann Arbor, MI USA Jun. 28-Jul. 2, 1993, New York, NY USA IEEE, Jun. 28, 1993, pp. 800-803, XPO10132618 ISBN Q-7803-1246-5.

* cited by examiner

*Primary Examiner*—Michael C Wimer
(74) *Attorney, Agent, or Firm*—Rozenblat IP LLC

(57) ABSTRACT

A method and apparatus are provided for controlling grating side lobes in a faceted mesh reflector. Facets may be formed of a like shape but with a majority of the facets across the reflector having varying size which reduces the grating lobe intensity in the far field pattern.

29 Claims, 14 Drawing Sheets

METHOD AND APPARATUS FOR GRATING LOBE CONTROL IN FACETED MESH REFLECTORS

CROSS-REFERENCE TO CO-PENDING APPLICATION

This application is related to copending application of Samir Bassily entitled "Arbitrarily Shaped Deployable Mesh Reflectors", commonly owned by the same assignee as this application, the entirety of which is incorporated by reference herein.

BACKGROUND

1. Field of the Disclosure

The disclosure relates generally to mesh reflectors for antennas and more particularly to mesh reflectors for antennas that may be used on spacecraft, and that may be stowed in a launch vehicle and subsequently deployed in outer space.

2. Background of Related Art

Over the past four decades, several styles of deployable mesh reflectors have been developed. The great majority of them were intended to approximate parabolic reflector surfaces, although any of them can theoretically be made to approximate other slowly varying surfaces, provided those surfaces do not have regions of negative curvature (i.e., are always curved towards the focus of the reflector). In more recent years, "shaped reflector" technology was developed and is gaining dominance in the space antenna field. So far, however, this technology has been limited to relatively small solid-surface (or segmented surface) reflectors due to limitations imposed by the fairing sizes of the launch vehicles on which they are flown.

A soft knitted mesh fabricated out of a thin metallic wire (preferably of gold-plated molybdenum) is commonly used to form the reflective surface of deployable radio-frequency (RF) antenna reflectors, especially for space-based applications (e.g., for communication satellites). The mesh may be placed and maintained in a desired shape by attaching it to a significantly stiffer net. One problem associated with the fabrication of such a mesh surface entails the ability to maintain the tension in the mesh within a certain desired range, and to terminate/cut the mesh edges in a manner that does not produce objectionable passive inter-modulation (PIM) or electro-static discharge (ESD), through the use of an appropriate mesh edge treatment.

The ASTRO-MESH Iso-Grid Faceted Mesh Reflector (hereinafter a "Type 1" reflector) is one example of a mesh reflector (see, e.g., U.S. Pat. No. 5,680,145). In this type of reflector, the mesh surface comprises a large number of triangular, substantially-flat facets. When viewed from a certain direction, the great majority of those triangles appear to be equilateral. The mesh facets are given their shape by being pulled behind a relatively stiff (ideally inextensible) set of highly tensioned straps forming a net with triangular openings. The net is pulled into shape by a set of springs pulling it backwards towards a similar (but possibly shallower) net disposed behind the mesh and curved in the opposite direction.

Another type of reflector is the Radial/Circumferential Faceted Mesh reflector (hereinafter a "Type 2" reflector). The most common examples of this type of reflector are the umbrella-style Radial-rib reflectors used on the TDRS antenna and on the folding-rib reflectors currently produced by Harris Corp, of Melbourne, Fla.

Yet another Type 2 reflector is shown and described in U.S. patent application Ser. No. 10/707,032, filed on Nov. 17, 2003, the entirety of which is hereby incorporated by reference herein. In this type of reflector, the mesh facets are generally of trapezoidal shapes bounded by a set of radial chords typically coincident with or near the location of, the reflector ribs, and by sets of chords forming concentric polygons extending between those ribs. Often, those substantially circumferential chords are made to more closely conform to the desired surface geometry by pulling down on them (i.e., in a direction pulling the surface away from the reflector focal point) with a set of adjustable tension ties. The loads in these tension ties are typically reacted by another set of chords forming a second set of concentric polygons disposed behind the set of polygons bounding the mesh facets.

Another type of reflector is known as a wrap-rib Parabolic-Cylindrically Faceted Mesh reflector (hereinafter a "Type 3" reflector). The wrap-rib reflector of Lockheed Martin of Bethesda, Md. has a mesh surface that comprises a relatively small number of facets each approximating a parabolic cylinder. Each of these facets is bounded by two curved parabolic ribs, an outer catenary member, and a part of the circumference of a central hub. The mesh used on these reflectors is designed to have very low shear stiffness and Poisson's ratio, which minimizes its tendency to "pillow" (or curve inwardly—i.e. towards the reflector focus—between the ribs). Typically, this type of reflector would only contain between one and several dozen facets.

With these current mesh reflectors, the surface of the mesh is divided into flat (or nearly flat) equally sized facets. The faceted reflectors are typically used to approximate the curved surface of an ideal parabolic reflector, which has a single main antenna lobe in their far field RF patterns. In application, however, these reflectors, having facets of equal size, stray from that ideal and produce relatively high side lobes in addition to the main lobe in the far field RF pattern. These side lobes, known as grating lobes, divert useful RF energy away from that main antenna lobe. These grating lobes are similar in shape to the main lobe and are spaced from the main lobe by an angle that often puts the grating lobes on areas outside the desired (and/or permitted) antenna coverage area, thereby causing undesirable interference with communications in those outlying areas.

There is a need for a technique for controlling the grating lobes produced by faceted mesh reflectors and spacing those grating lobes even farther apart from the main antenna lobe. There is also a need for a technique for diminishing the gain profile of these lobes to reduce interference with other communication signals.

The present disclosure is directed to overcoming one or more of the problems or disadvantages associated with the prior art.

SUMMARY OF THE INVENTION

In accordance with one aspect of the disclosure, a method and apparatus for controlling a grating lobe of a faceted mesh reflector are provided. The method and apparatus in some examples reduce the peak of these grating lobes, which appear as several localized non axi-symmetric side lobes spaced at an angular distance from the main antenna lobe, by forming the mesh reflector of varying-sized facets, which reduces the number of facets contributing to each of the grating lobes.

According to some examples, a mesh reflector includes a mesh reflecting surface comprising a plurality of substantially flat regions having a quadrilateral shape, wherein the plurality of substantially flat regions comprise regions of varying sizes; and a reflector frame for supporting the mesh reflecting surface. In some such examples, the mesh reflecting surface comprises a first region and a second region, and the substantially flat regions are formed as facets with the facets at the first region being smaller in size than the facets at the second region. Example facet geometries include rectangular and parallelogram shaped facets.

According to some further examples, the variations in size of the facets may occur between a center region and an outer edge region of a mesh reflector, such as where the size increases from the center region to the outer region. In yet, other examples, the variations may be between a first side of a mesh reflector and another side of the reflector, or across any regions of the reflector. Alternatively, in some examples, random size variations may be used to reduce grating lobe peaks in the far field.

In accordance with other examples, a mesh reflector comprises a mesh reflecting surface having a plurality of substantially flat regions formed as triangular facets of varying sizes; and a reflector frame for supporting the mesh reflecting surface.

In accordance with another embodiment, a method of forming a mesh reflector includes providing a reflector frame; mounting a mesh reflecting surface on the frame; and forming a plurality of substantially flat regions in the mesh reflecting surface and having a first shape, wherein the plurality of substantially flat regions comprises regions of varying sizes.

In some examples, the faceted mesh reflector is adapted to be stowed in a launch vehicle and subsequently deployed in outer space. To facilitate such application, according to some examples, a first set of elongate members is attached to the mesh reflecting surface in order to shape it by applying forces in a direction substantially perpendicular to the surface, and a second set of elongate members is attached to the mesh reflecting surface and extending in different directions across the mesh reflecting surface dividing it into the plurality of substantially flat regions. In some such examples, the second set of elongate members includes two subsets of substantially parallel elongate members extending in two different directions and having varying spacing to form the plurality of substantially flat regions as parallelogram-shaped facets.

The features, functions, and advantages can be achieved independently in various embodiments of the present disclosure or may be combined in yet other embodiments.

DETAILED DESCRIPTION

Figure 1:
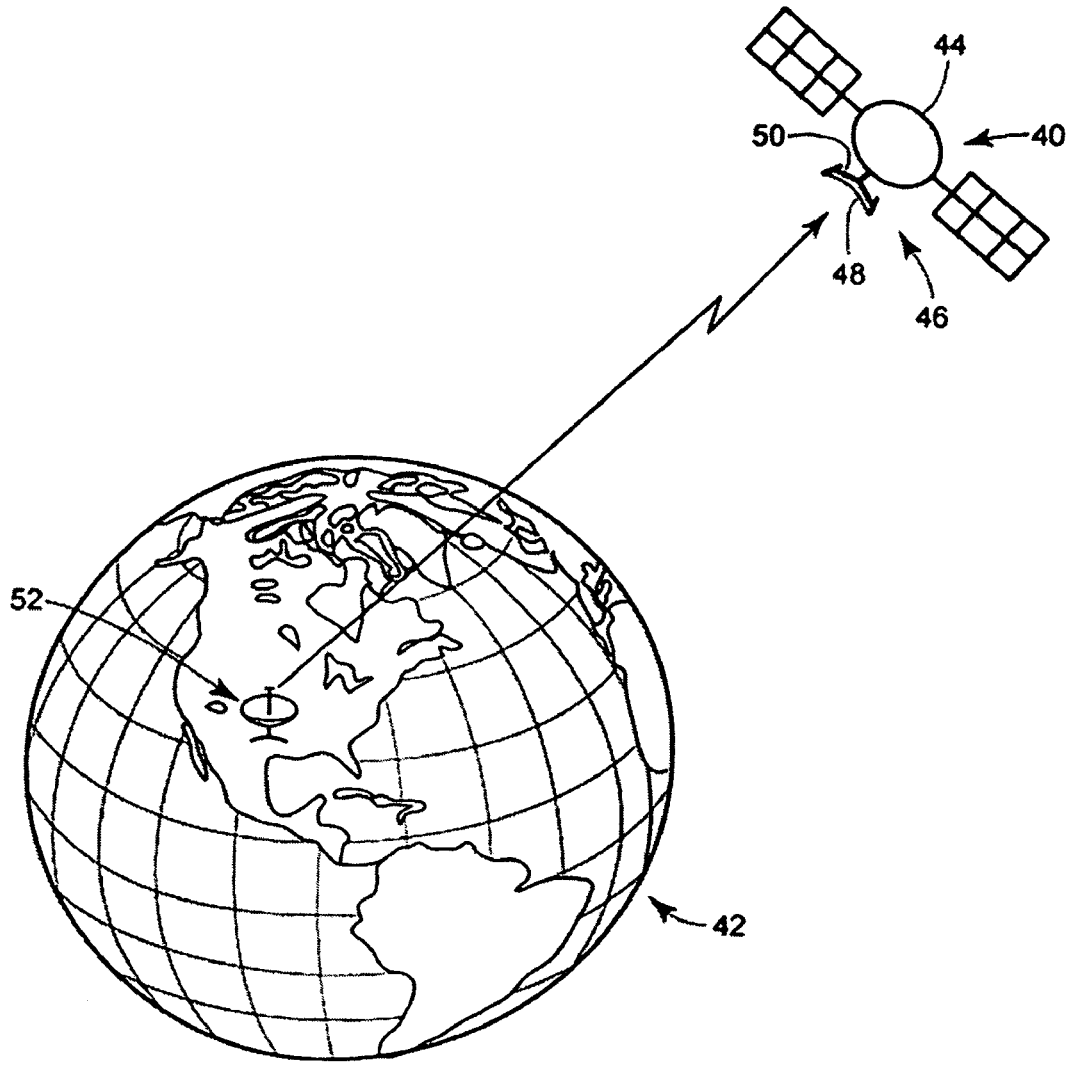
FIG. 1 is a perspective view of a satellite that includes a deployable reflector in orbit about the earth.

In FIG. 1, a perspective view of a satellite 40 in orbit about the earth 42 is illustrated. The satellite 40 itself includes both a body 44 and a deployable mesh reflector type antenna 46 mounted thereon. The deployable antenna 46, in turn, includes both a reflective mesh 48 and a supportive framework 50 for deploying and suspending the mesh 48. In having the deployable antenna 46 onboard, the satellite 40 is able to send and receive electromagnetic waves for thereby communicating with, for example, a ground communications station 52 while the satellite 40 is in orbit in outer space.

Figure 2:
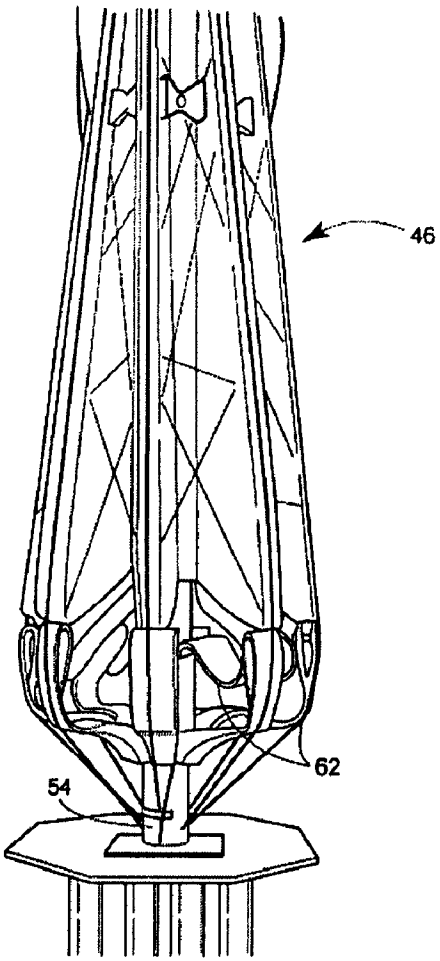
FIG. 2 is a diagrammatic perspective view taken from the side showing a deployable reflector in a stowed configuration.
Figure 3:
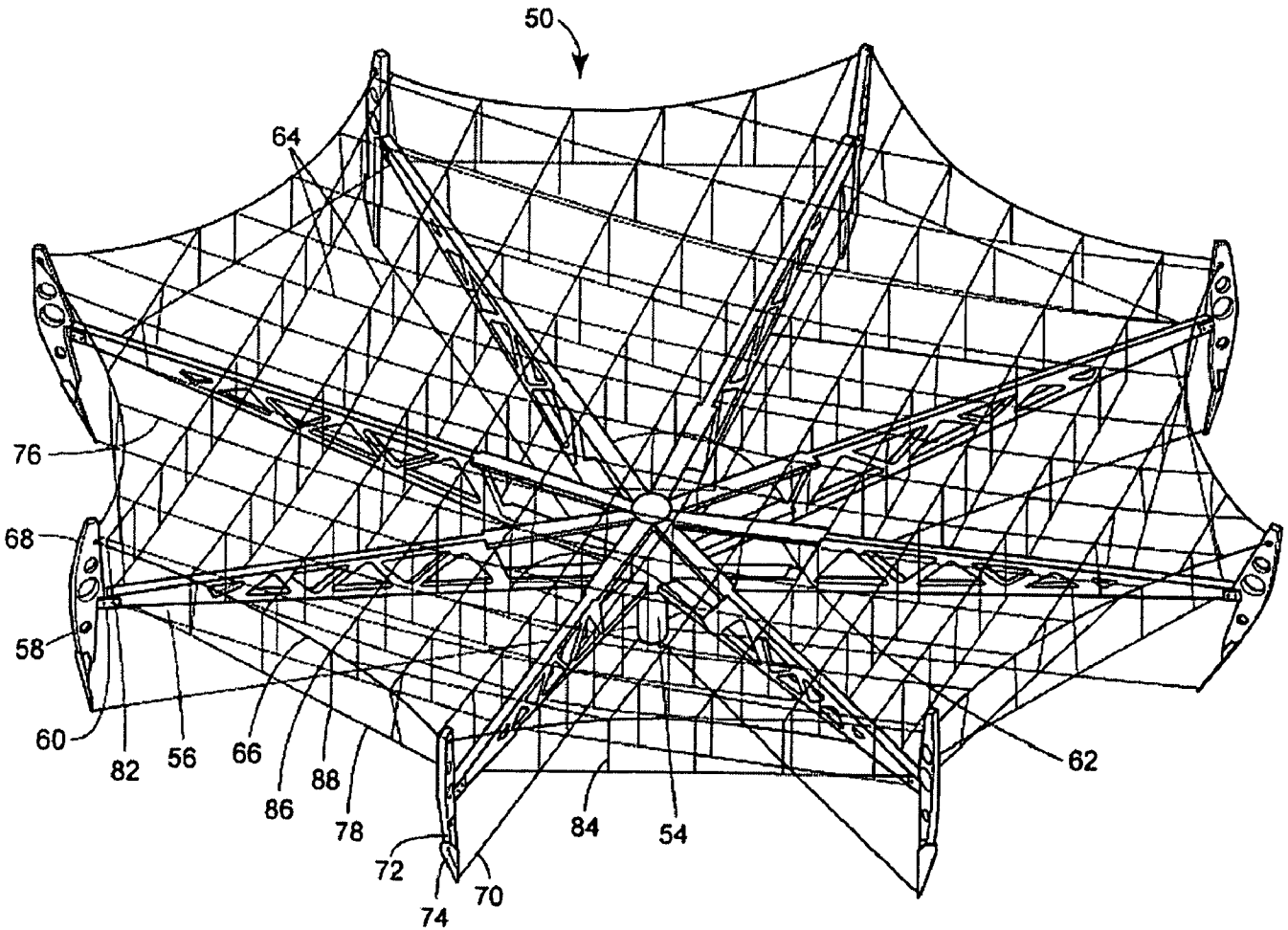
FIG. 3 is a diagrammatic perspective view of structural components that shape and form a reflector surface.
Figure 4:
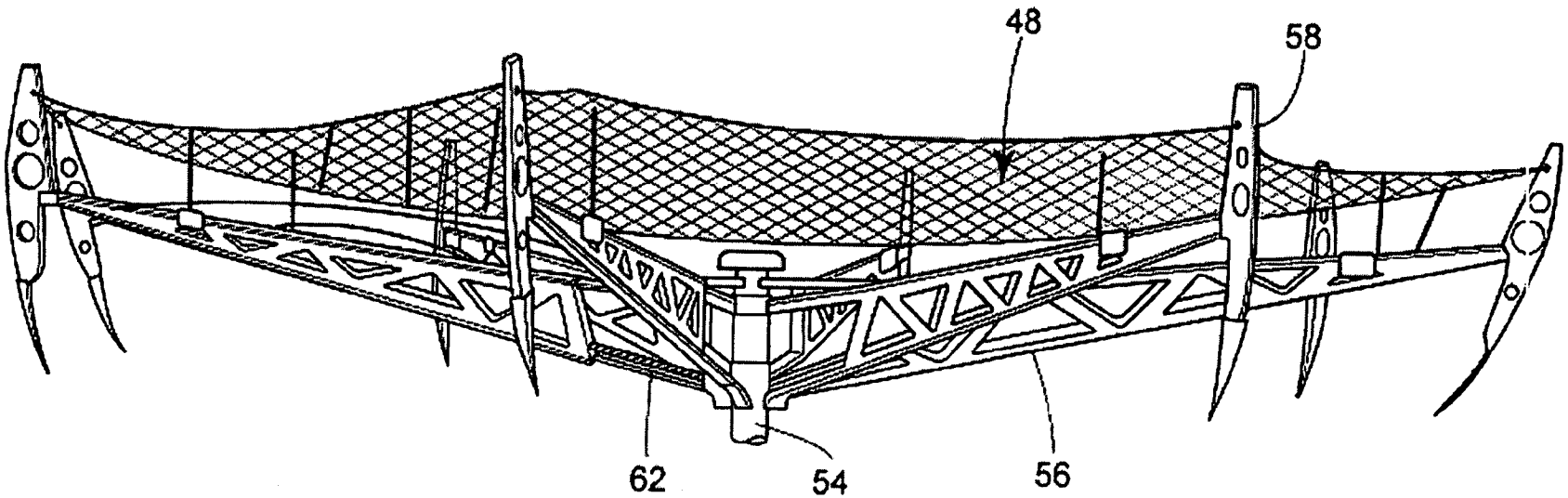
FIG. 4 is a diagrammatic perspective view taken from the side of a deployable reflector.
Figure 6:
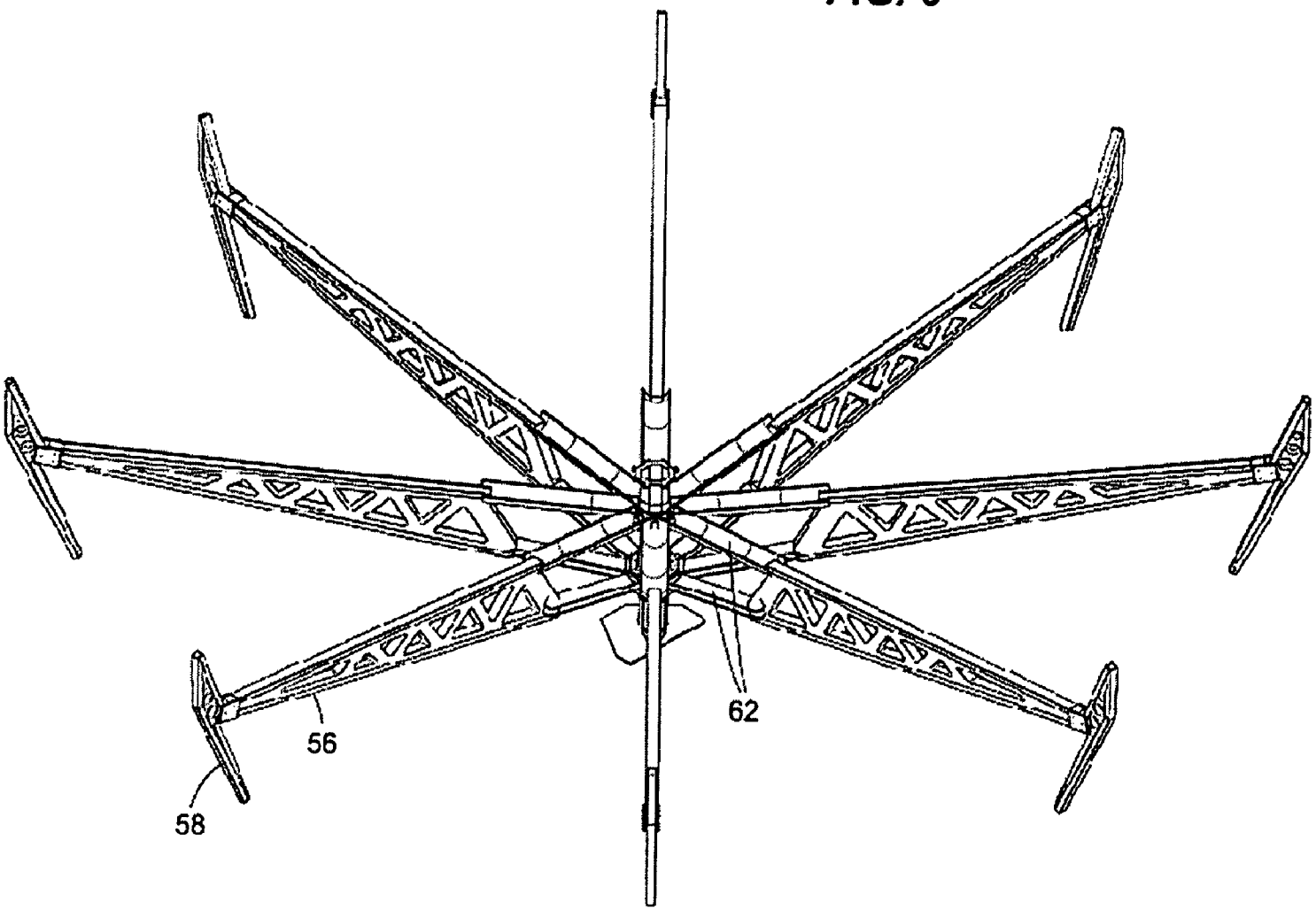
FIG. 6 is a diagrammatic perspective view showing the backing structure of a deployable reflector.

The reflector 46 is shown in FIG. 2 in a stowed configuration and in FIGS. 3 and 4 in a deployed configuration, and FIG. 6 the example backing structure alone.

The reflector support structure may comprise a slender composite hub 54 carrying eight radial ribs 56 with eight pivot arms 58, each mounted at a tip 60 of rib 56.

The ribs 56 may be attached to the hub 54 via foldable multi-layered "carpenter's tape" composite hinges 62.

The reflective mesh 48 may be knitted out of Gold-plated Molybdenum wire.

The reflective mesh 48 may be tensioned and sewn to a net 64 made of relatively stiff thermally and environmentally stable chords preferably braided out of Vectran® (a liquid crystal polymer) or Quartz fibers.

The net 64 may be attached to a set of outer catenaries 66 spanning between the upper ends 68 of the pivot arms 58. These catenaries 66 are preferably made out of heavier chords braided out of the same fibers as the net 64.

Tension may be provided to the net 64 and maintained substantially constant, by a set of radial tensioners 70 connecting the hub 54 and to lower ends 72 of the pivot arms 58 via composite flexures 74. The radial tensioners 70 may be made out of the same material as the outer catenaries 66.

Net chords 76 may be arranged to form a plurality of shaped openings of equal or slightly varying sizes. Openings may be rectangular, parallelogram, or triangular shaped, for example.

A set of aft reaction catenaries 78 may span between aft ends of the ribs 56 and connect to the ribs 56 via small composite flexures 82.

The reflective mesh 48 and the net 64 may be shaped by a set of substantially perpendicularly extending drop ties 84 connecting the corners 86 of the net 64 to points 88 along the aft catenaries 78.

Figure 5:
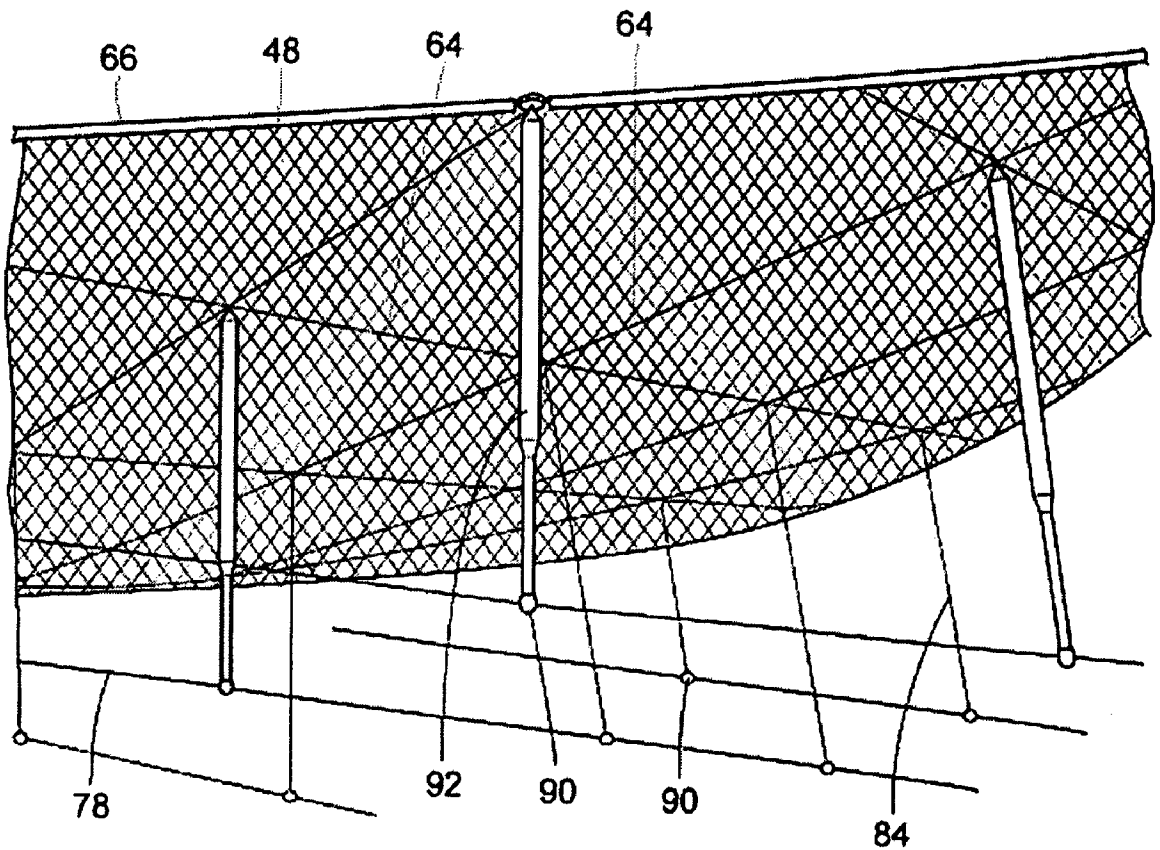
FIG. 5 is an enlarged diagrammatic perspective view of a portion of the reflector of FIG. 4.
Figure 7:
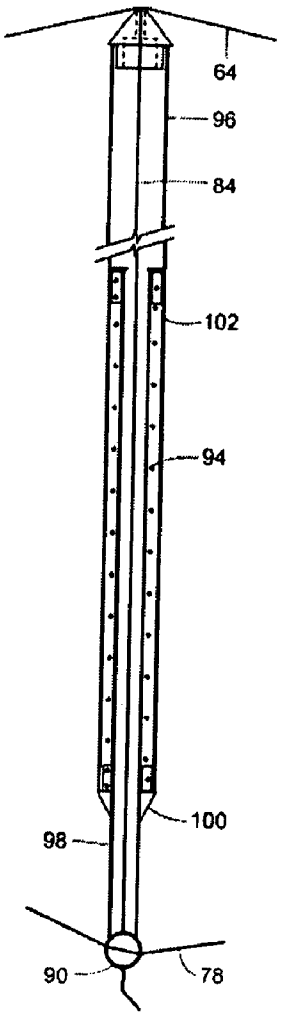
FIG. 7 is a cross-sectional view of a compression rod that may be used to maintain a reflector surface in a desired shape.

The drop ties 84 may attach to the aft catenaries 78 via small smooth beads 90 (FIGS. 5 and 7) through the use of a patented adjustable knot, permitting easy and precise adjustment of their length in order to shape the surface of the reflective mesh 48 (U.S. Pat. No. 6,030,007, the entirety of which is hereby incorporated by reference herein). Preferably, the drop ties are made of the same material as the net chords.

Where the desired surface shape requires the drop ties to push up on the surface, compression rods 92 (shown in further detail in FIG. 7) may be used.

Each compression rod 92 may include a spring 94 (e.g., a tension helical spring) that may be disposed between an outer tube 96 and an inner tube 98 that are separated by electrically insulating bushings 100 and 102, that may be made from a plastic material, such as Ultem 1000, available from GE Plastics. A tension capable elongate member such as a drop tie 84 may extend through the center of the compression rod and be used to attach it to the aft catenaries 78 via small smooth beads 90 through the use of an adjustable knot such as mentioned above.

Figure 8:
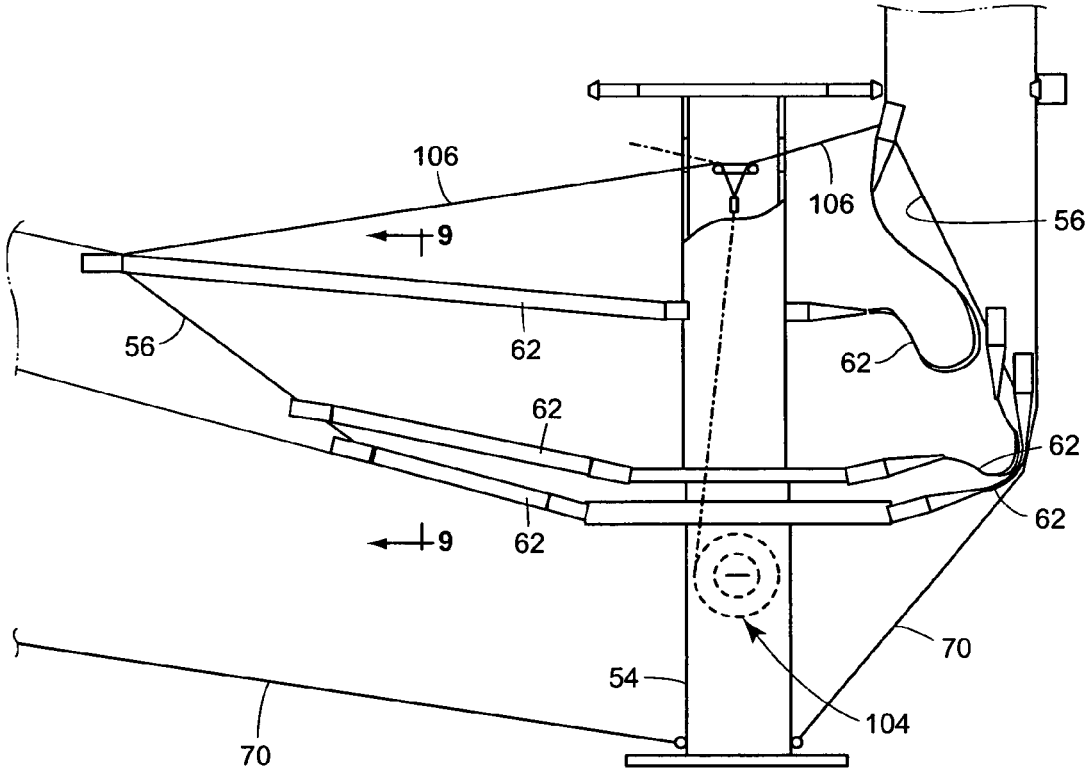
FIG. 8 is a schematic view taken from the side showing a restraint and coordination mechanism for a deployable reflector.
Figure 9:
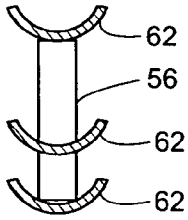
FIG. 9 is a cross-sectional view, taken along lines 9-9 of FIG. 8, showing a hinged structure for a deployable reflector.

A central mechanism 104 may be located within the reflector hub 54 (see FIG. 8). The mechanism 104 provides drag force/torque during the rib deployment. Examples of devices that should serve as the mechanism include eddy-current dampers; viscous dampers; friction dampers; and electric motors (e.g., stepper motors and/or DC motors) with appropriate reduction gear-heads.

The control mechanism 104 may be attached to each of the ribs 58 via a flexible member (lanyard) 106 such as a strap or a chord. The lanyards 106 may be arranged such that they have equal lengths at all times during the deployment of the ribs 56.

In order to avoid the possibility of instability of the system of compression rods 92 and the chords 76 connected to them, the top ends of each of the compression rods 92 (those on the side to which the mesh is attached) are stabilized by the chords 76 extending in two different directions (nearly perpendicular to each other in this preferred embodiment). This is unlike the radial-rib and folding-rib reflectors which have chords extending in two directions (radial and circumferential) only at certain points, with the majority of the points having only circumferential chords.

Figure 10:
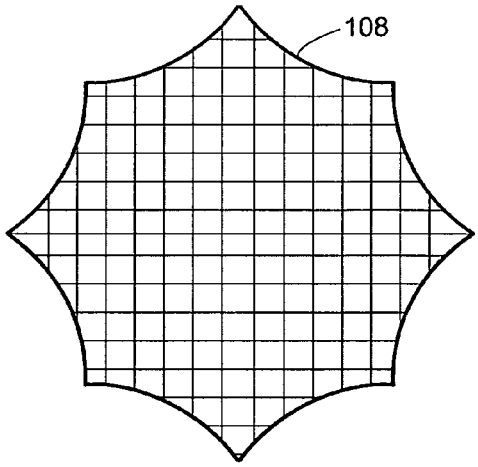
FIG. 10 is a plan view of a configuration of a net structure for a faceted reflector having a plurality of square-shaped regions.
Figure 11:
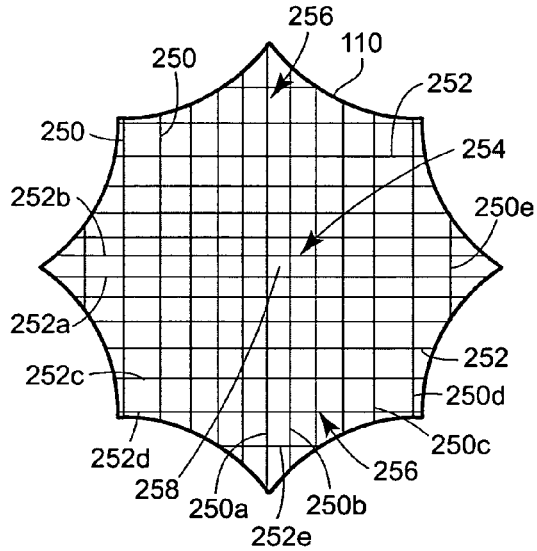
FIG. 11 is a plan view of a net structure for a faceted reflector having a plurality of variable-sized rectangularly shaped regions.
Figure 12:
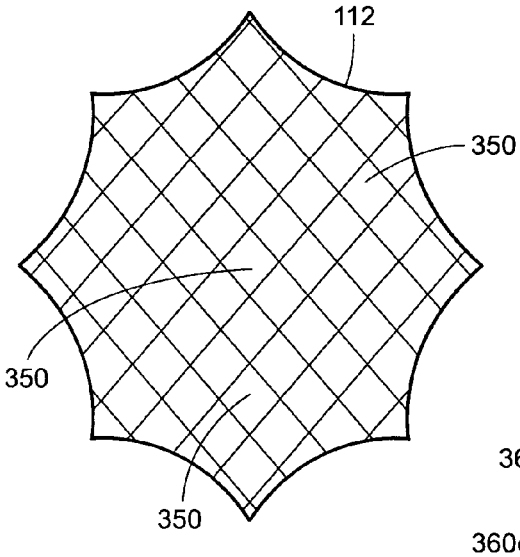
FIG. 12 is a plan view of a net structure for a faceted reflector having a geometry that includes a plurality of rhombus-shaped regions.
Figure 13:
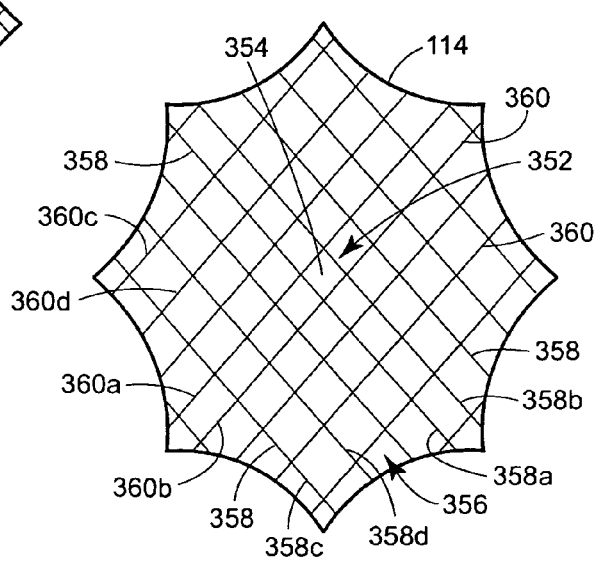
FIG. 13 is a plan view of a net structure for a faceted reflector that includes a plurality of variable sized parallelogram-shaped regions.

In some examples, all of the surface chords may essentially run in one of two basic directions (except for the outer perimeter members which form a polygon and run in a nearly circumferential direction). In one embodiment, chords may form a net 108 with substantially square openings (FIG. 10). In another embodiment, chords form a net 110 having rectangular openings of varying sizes (FIG. 11). In a third embodiment, chords form a net 112 having rhombus-shaped openings (FIG. 12). In another example, chords form a net 114 having parallelogram-shaped openings of varying sizes (FIG. 13). By forming the mesh reflector of a net having facets of varying sizes, such as in FIGS. 11 and 13, it has been found that the grating side lobes created by mesh reflectors of a net having equally sized facets, such as in FIGS. 10 and 12, may be significantly reduced. The illustrations are provided with outer catenaries that are shown by way of example, but not referenced by numeral. Further, for readability sake, not all facets, regions, chords, etc. are referenced by reference numerals in the mesh reflector figures.

Figure 14:
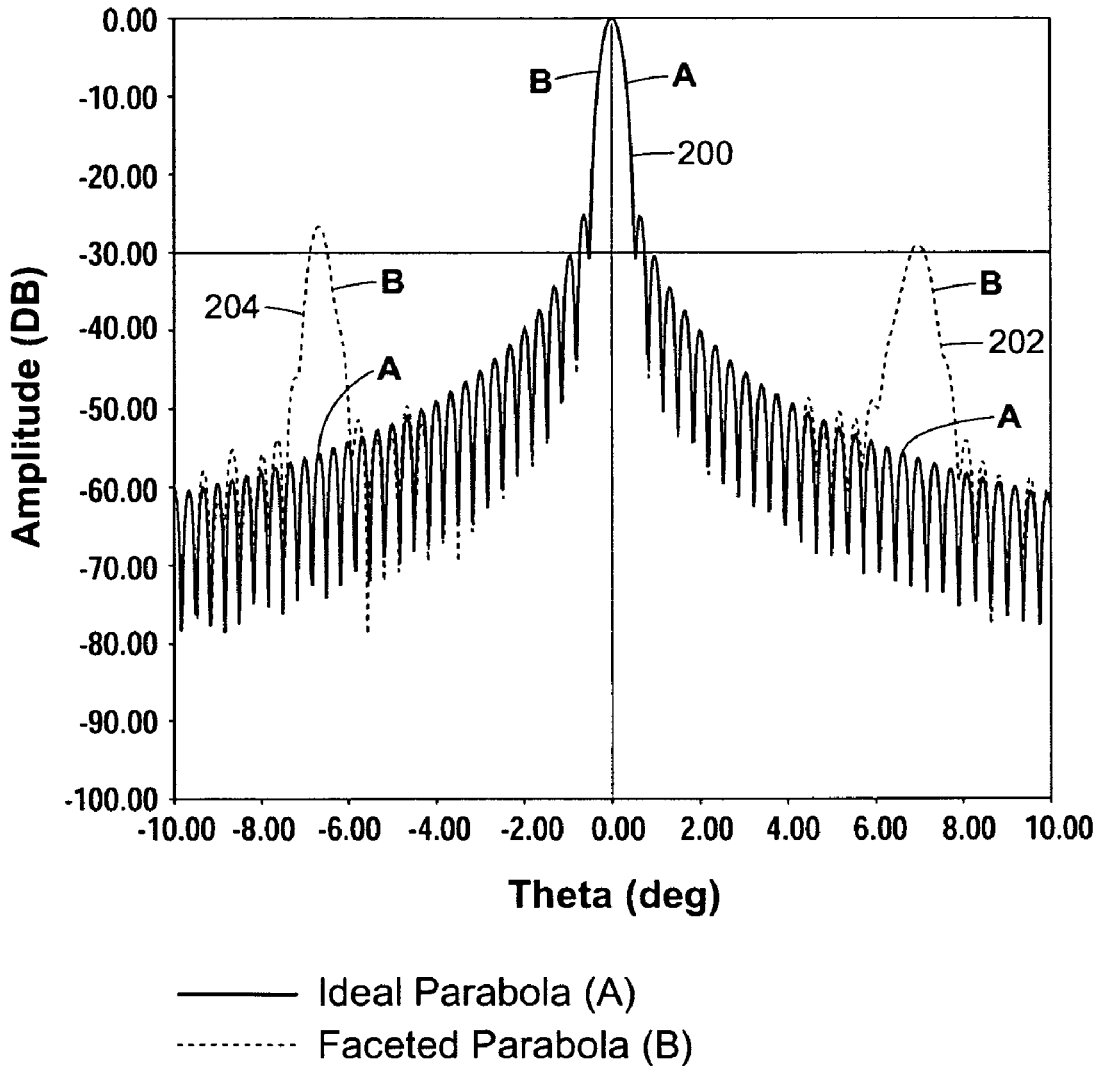
FIG. 14 is a plot of beam profiles in the far field for an ideal parabolic reflector and a faceted parabolic reflector like that of FIG. 10.

The plot in FIG. 14 of gain amplitude versus angle for a far field radiation pattern illustrates the problem with grating lobes. The plot compares the RF performance of an example 140" diameter antenna having an ideal parabolic reflector (plot A) with that of an example mesh reflector having a faceted net divided into equal 7"×7" square facets (plot B), both reflectors operating at 14.4 GHz. The plot was created using the GRASP computational reflector antenna software, available from TICRA Corp., although any software or modeling system capable of producing far field antenna beam profiles of gain versus angle may be used. Both plots A and B have a main antenna lobe 200 (only a single reference numeral is used due to the overlap in the illustration) of approximately the same beam width. Other than a slight reduction in peak lobe gain of 0.05 dB between the plots A and B, known as the faceting loss, the plots A and B differ primarily by the presence of two large grating lobes 202 and 204 at about +/−6.7 degrees, respectively, for the faceted mesh reflector of plot B. These grating lobes 202 and 204 represent a substantial departure from the beam profile of the ideal parabolic reflector. In this particular example, these grating lobes 202 and 204 are as high as −26.8 dB relative to the peak gain of the ideal parabolic reflector beam, which is almost as high as the gain of the first side-lobe. The grating lobes 202 and 204 are also significantly wider than the main antenna lobe 200.

Whereas the main lobe is axi-symmetric about the zero-degree axis, these grating lobes 202 and 204 are not, but rather are localized at the offset angle and in a particular direction (e.g., an x-direction). For a square faceted structure, additional grating lobes would be present along an orthogonal direction (e.g., a y-direction), and along each of the +/−45 degree directions bisecting these orthogonal directions (i.e., bisecting the x and y axes), producing eight localized grating lobes.

To reduce the grating lobes produced by such a reflector, variable size facets may be formed over the mesh reflector in place of uniformly sized facets. In particular, the faceted shape of the reflecting surface of a mesh reflector may be controlled by the geometry of the chords (or straps) arranged to form a net. In an example, the set of chords forming the net are arranged in two groups each containing a number of chords which run substantially parallel to each other, where the groups of parallel chords define facets of varying size over at least a portion of the mesh reflector.

In the example of net 110, two groups of chords 250 and 252 run substantially perpendicular to each other whereby they form a net with rectangular openings. The spacings between the parallel chords 250 and the parallel chords 252 are made to vary in the illustrated example to form varying sized facets. The net 110, for example, has a first region 254 (e.g., a center region) that comprises rectangular facets of a smaller size than the facets at a second region 256 (e.g., an outer edge region) of the net 110. A center facet 258 may be a square facet smaller in size than the other facets formed along the chords 252*a* and 252*b* moving from the center 254 to the outer edge region 256. The facet sizes along the chords 250*a* and 250*b* also increase in size as compared to the center facet 258. In the illustrated example, the facet increase, both along chords 252*a* and 252*b* or chords 250*a* and 250*b*, is a gradual increase from the center region 254 to the outer edge region 256, with each adjacent facet along a radial direction having a different size. Alternatively, the size variation may take on other patterns. The variation needs not be gradual, for example. Chords may be formed such that the facet size varies in a discrete patterned manner, for example with at least some adjacent facets having identical size. A discrete pattern of facet sizes such as AA-BB-CC or AAA-BBB-CCC (with A, B and C representing different facet surface areas and with A<B<C) may be used, for example. Further, facet size may decrease as you move from the first region 254 to the second edge region 256, such that the center region 254 has the largest sized facets. Further still, the variation in facet size for the net 110 may be random, so long as the variation is occurring over the region of illumination for the net 110.

To achieve the varying size, the chord spacing is altered across the net 110. In the illustrated example, the spacing distance between chords 252*a* and 252*b* represents the smallest chord spacing for the 252 chords, whereas the chord spacing between chords 252*c* and 252*d* (ignoring the shortened chords 252*e*) is the largest. Similarly, the chord spacing between the chords 250*a* and 250*b* is smallest compared to the chord spacing between the chords 250*c* and 250*d* (ignoring the shortened chords 250*e*).

Figure 15:
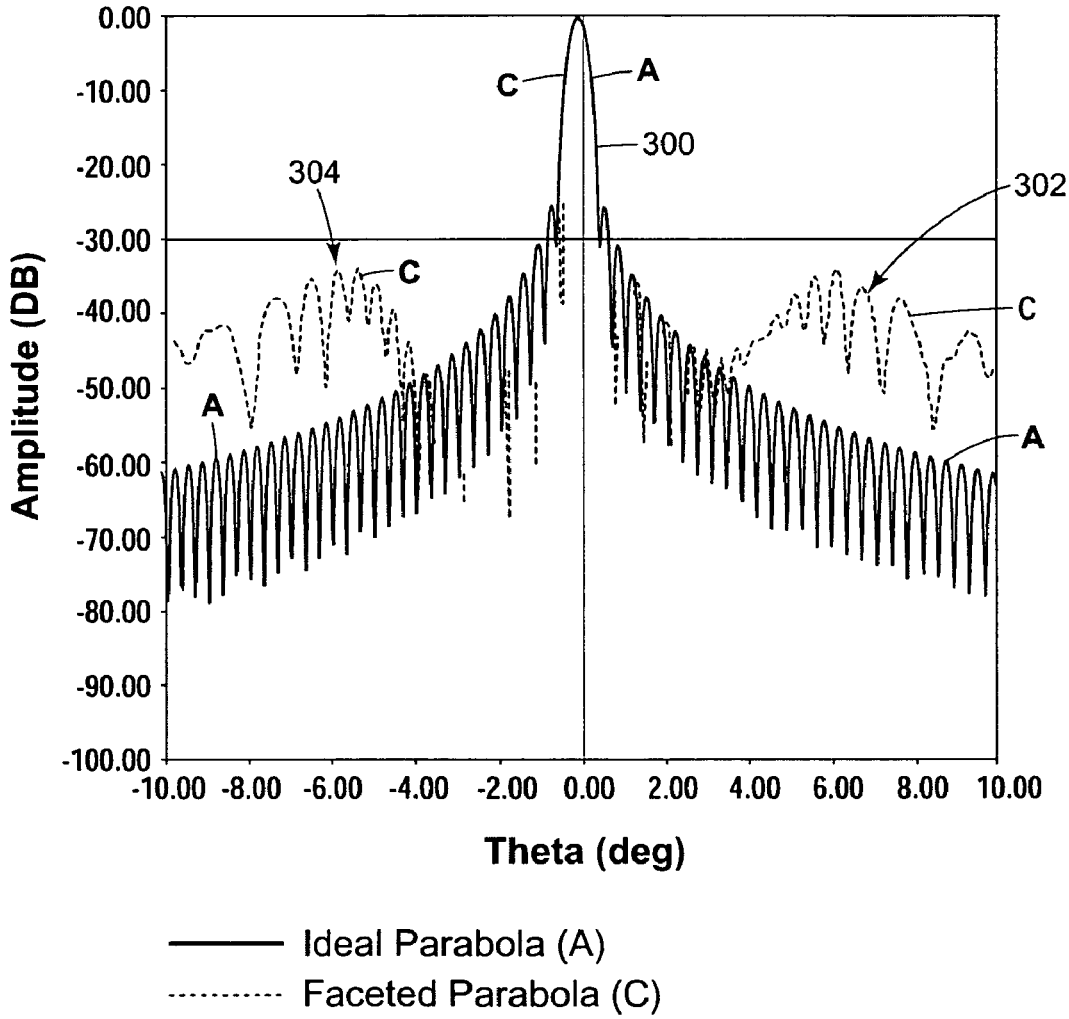
FIG. 15 is a plot of beam profiles in the far field for an ideal parabolic reflector and a faceted parabolic reflector like that of FIG. 11 having varying size rectangularly shaped regions.

FIG. 15. shows a plot of gain amplitude versus angle for a far field radiation pattern to illustrate an example benefit of varying facet size. The plot compares the RF performance of a 140" diameter ideal parabolic reflector (plot A) with that of an example faceted mesh reflector having a chord spacing that varies from 6" at a center region of the reflector to 9" at its outer edge region to form rectangular facets of varying size (plot C). Plots A and C share a main antenna lobe 300, which may have a similar beam width for each plot. Unlike plot B of FIG. 14, however, plot C has grating lobe regions 302 and 304 observed at about +/−6.7 degrees, respectively. When compared to the grating lobes 202 and 204, it is apparent that the lobes have been broken down to about a half dozen lobes each, and their gain levels have been reduced by over 6 dB's (or a factor of 4) compared to the grating lobes 202 and 204. Furthermore, this break down in grating lobes has been achieved while the peak of the main antenna lobe 300 has remained practically unchanged.

In an antenna with an ideal parabolic reflector, (as well as one with a faceted reflector) the antenna main lobe is formed in the direction where all the flux reflected off the reflector surface forms a uniformly-phased planer wave (in the direction of the bore-sight if the feed is at the reflector focus). Since all the flux is in-phase, the flux intensity at the bore-sight equals the arithmetic sum of all the flux intensities produced by all the facets of the reflector in the direction of the bore-sight.

With the reflector of some examples herein, the spacing between the rows of facets varies from row-to-row, e.g., with the reflector analyzed in FIG. 15 having only two pairs of facets (one on each side of the reflector center) possessing the same spacing S(n). As a result, each two pairs of facet rows spaced at S(n) apart (center-to-center) produce a small grating lobe at an angle θ(n) related to the spacing S(n) by the approximate equation $\sin[\theta(n)]=+/-\lambda/S(n)$, where λ is the wavelength of the RF waves being reflected. Due to the different spacing between the pairs of rows, multiple grating lobes may be formed (as can be observed from FIG. 15) while the gain level of those grating lobes is substantially reduced.

To determine the desired variation for effecting a desired grating lobe reduction, a designer may use known modeling techniques such as using GRASP to model the antenna and produce the resulting beam profile. Other techniques such as actual far field testing maybe used as well. In addition to the example variation patterns discussed above, additional consideration for design may be used to craft a desired grating lobe profile. For example, each grating lobe is contributed to by only a small number of rows of facets, instead of the entire reflector. Four rows of facets may contribute to one of the stub grating lobes shown in regions 302 and 304, for example. Also, the rows nearest the center of the mesh reflector, which receive the highest illumination flux from the antenna feed, may be reduced in width (and thus area) relative to the rows of the uniformly faceted reflector, resulting in further reduction in the level of grating lobes produced by those rows. Conversely, the rows near the outer edges of the mesh reflector, which have been increased in width relative to the uniformly faceted reflector, receive reduced levels of illumination from the feed (typically by an order-of-magnitude) which may also result in lower level grating lobes (than those produced by the inner rows). Further still, the reduced spacing on the inner (highly illuminated) rows of facets results in an increase in the corresponding grating lobe angle θ by the equation in paragraph [0062]. As a result, the grating lobes they produce will involve a larger scan angle, resulting in further reduction in the level of the grating lobes due to the scan characteristics of the facets acting as radiating elements.

The net 112 of FIG. 12 comprises a plurality of equally sized rhombus-shaped facets 350, which configuration would produce grating lobes due to the uniform nature of the facet spacing. To reduce the grating lobes, the net 114 of FIG. 13 is formed of parallelograms of varying sizes, some of which can be rhombuses. A first region 352 (e.g., a central region) comprises a central facet 354 that, in the illustrated example, is smaller than parallelogram facets at a second region 356 (e.g., an outer edge region). The facets are formed by two sets of parallel chords 358 and 360 extending across the net. To form the varying sized facets, for example, chords 358*a* and 385*b* bounding the central facet 354 are spaced a spacing distance shorter than chords 358*c* and 358*d* at the outer edge region 356. Similarly, chords 360*a* and 360*b* are spaced closer together than chords 360*c* and 360*d*. As with the net 110 described above, the corresponding facets may gradually or periodically increase in size as you move from the center region 352 to the outer edge region 356. Alternatively, the facets could decrease in size over that path or vary across the net 114 in another manner or in a random fashion.

Figure 16:
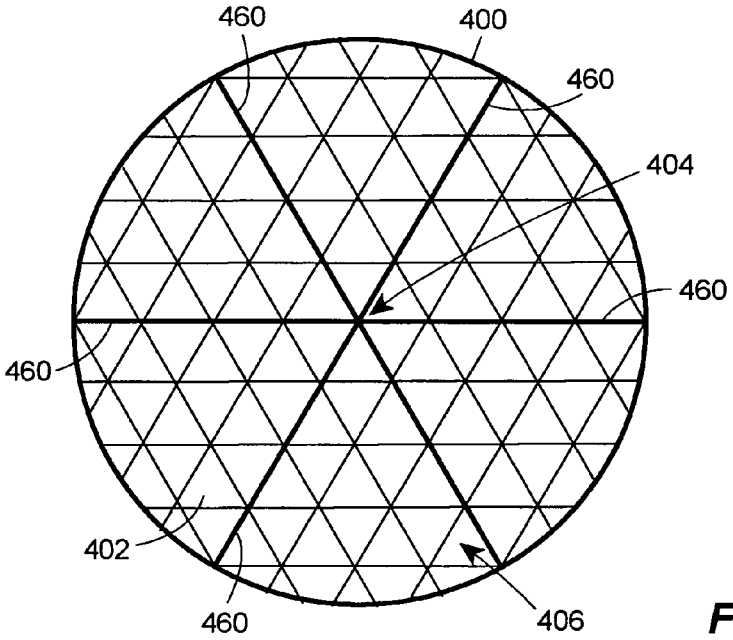
FIG. 16 is a plan view of a net structure for a deployable reflector having a geometry that includes a plurality of uniformly-sized triangular-shaped regions.
Figure 17:
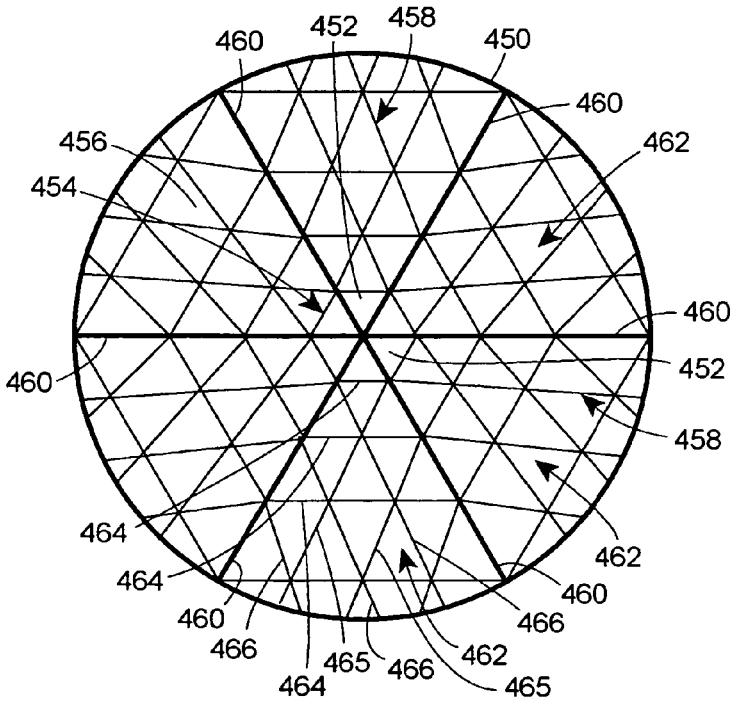
FIG. 17 is a plan view of a net structure for a faceted reflector that includes a plurality of variable sized triangular-shaped regions.

FIGS. 16 and 17 illustrate other example geometries for mesh reflector facets that can be varied in size to reduce the presence of grating lobes. FIG. 16 illustrates a net 400 formed of triangular facets 402 of uniform size. Examples of reflectors that may utilize this net style are the type 1 reflector and a variant of the type 2 reflectors which includes six radial ribs 460. A triangle faceted mesh with equally sized triangles over the substantial majority of the reflector will produce grating lobes. FIG. 17 illustrates a modified net 450 in which the triangular facets now vary in size, in this case from a smallest facet 452 (only two of the six being numbered) at a center region 454 to a largest facet 456 at an outer edge region 458. The net 450 is shown to be divided into six regions 462 by the six radial chords 460 (possibly aligned with six radial ribs of a type 2 reflector), each region 462 comprising sets of discontinuous chords 465, 464 and 466 forming acute angles with respect to one another. In other examples, a triangular faceted net of varying facet size may be formed with slightly curved continuous elongate chord members forming the varying size triangular facets across the net. Further still, while the illustrated chords are linear chords, in other examples chords curved in plan view may be used to form spherical triangles or other curvilinear triangles.

The net 450 is illustrated with a gradually increasing, smaller to larger, facet relationship moving from a center region 454 to an outer edge region 458. Yet, other variations may exist, including non-gradual variations, discrete patterns increasing in size from an outer edge region to a center region, and random variation. Exact geometries may be determined from far field modeling of beam profiles using techniques described above.

Figure 18:
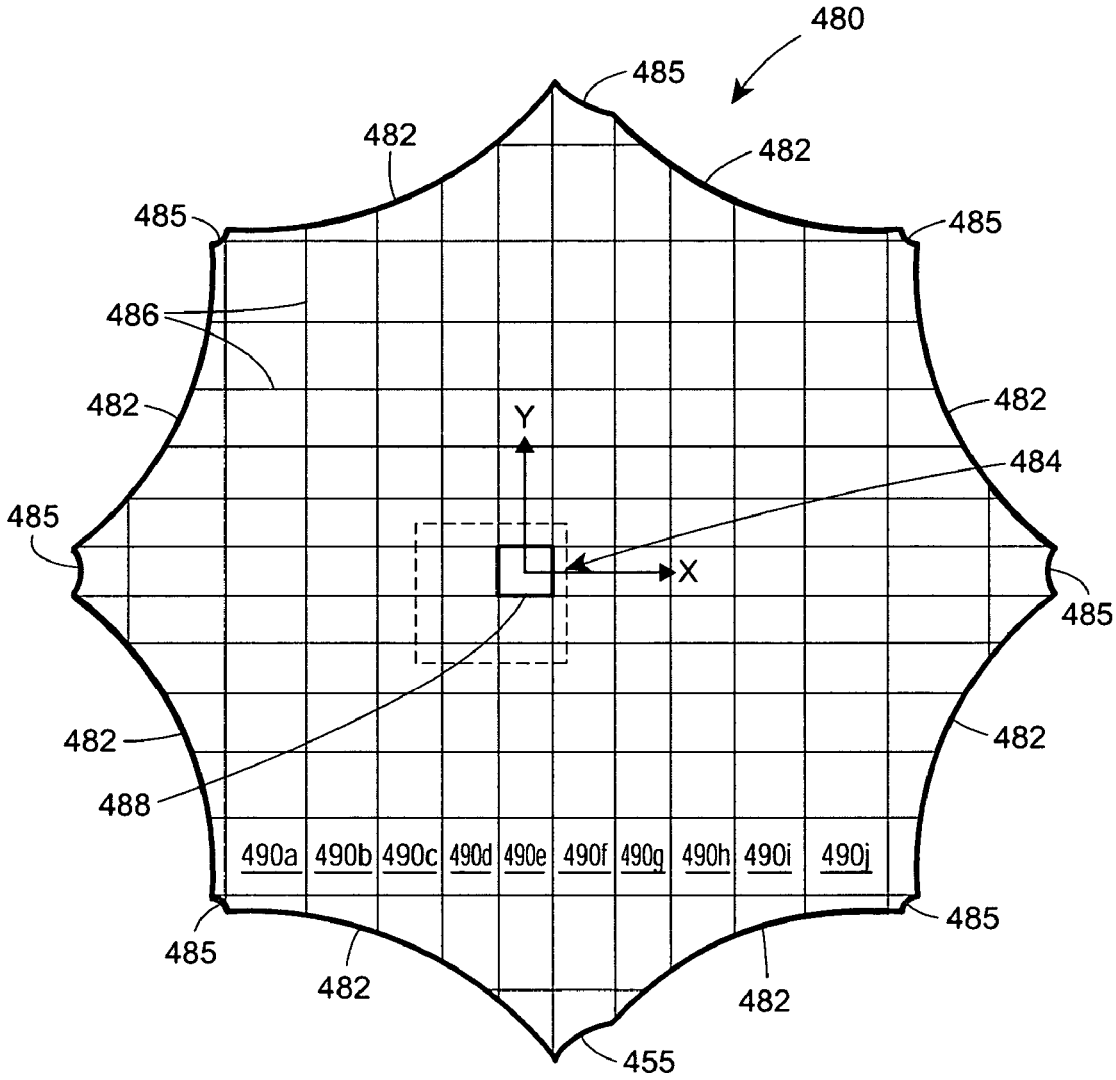
FIG. 18 is a plan view of a net structure for a faceted reflector that has its smallest facets near the center and its largest facets near the edges of the reflector.

FIG. 18 depicts another example mesh surface 480 of a reflector bounded by eight relatively shallow longer catenaries 482. The illustrated example also illustrates eight relatively more curved shorter catenaries 485. The mesh is attached to a rectangular net 486 that divides the mesh into a plurality of nearly flat rectangular facets of varying size. Facet 488 at a first region 484 has a first size that is smaller than the facets 490*a-j*, themselves of various sizes, at an outer region near the lower catenaries 482 and 485 in the minus y-direction. Thus, as this example illustrates, the region of smallest or largest sized facet is not limited to a center region but may be any region of the mesh reflector.

Figure 19:
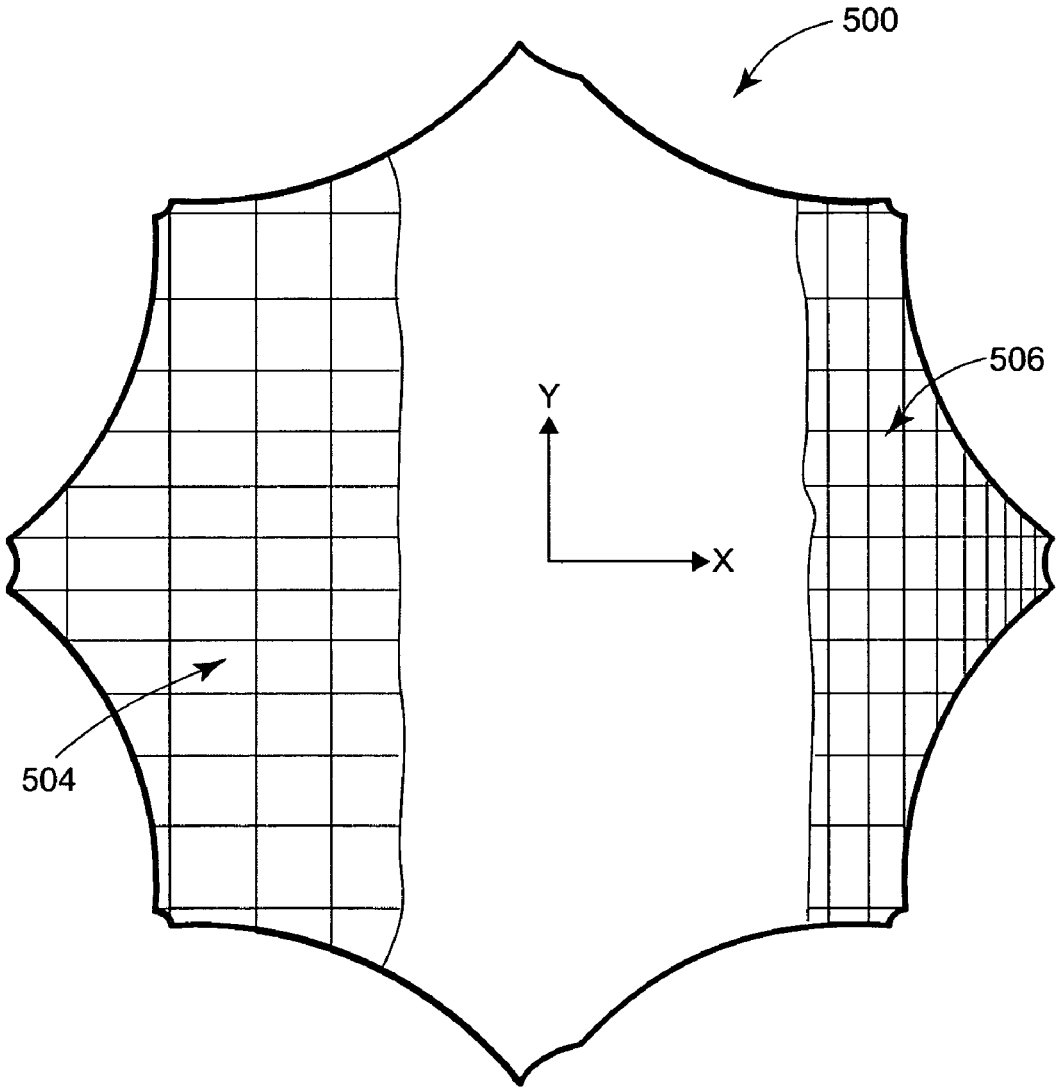
FIG. 19 is a plan view of a net structure for a faceted reflector with regions of different sized facets.

Another example mesh reflector is shown in FIG. 19. A first region 504 (partially shown) is positioned on one side of the mesh 500 and a second region 506 (partially shown) is positioned on an opposite side thereof. Facets in the first region 504 are quadrilateral in shape but have varying sizes that differ from the facets in the second region 506, which have a smaller size. Thus, this illustration shows left-to-right size decrease along an x-axis.

The above descriptions are provided by way of example. It will be apparent to persons of ordinary skill in the art that these techniques may be modified or applied in other applications. Facets taking geometric shapes other than those described above may be used, where at least some of the facets vary in size. Furthermore, although the above examples of FIGS. 10-19 describe mesh reflectors formed to model an ideal parabolic reflector, these mesh reflectors may be used to form any arbitrarily shaped antenna surface. Both symmetric and offset vertex parabolic reflector antennas may be formed. The reduction in grating lobes that results from varying facet size would benefit these arbitrarily shaped reflector antennas and offset vertex parabolic reflector antennas as well.

The number of facets in a net may be determined by the bounds of the smallest and largest facet sizes as well as by the aperture size of the portion of the net to receive radiation. That is the number of facets and the size variations among the facets may be determined over the entire net, i.e., to its outer edge, or only over that portion of the net that is to receive radiation. That is, only a portion of the entire reflector or illuminated region may be faceted with facets of varying size. Since the angle between the main lobe and the closest grating lobes of an antenna is approximately inversely proportional to the spacing between the rows of facets, and since the number of facets is inversely proportional to the square of the facet width, the number of facets is therefore approximately proportional to the square of the angle to the closest grating lobes. Thus, if one wanted to increase the angle between grating lobes and main lobe by a particular amount, one could determine the increased number of facets needed and from there determine what facet size variation will effect a desired grating lobe reduction, if reduction is still desired.

Various example facet geometries are described in the above examples: rectangular, parallelogram shaped, and triangular. Each of these geometries as used herein includes shapes that substantially take the geometric form, so that for example "rectangular" includes structures that are substantially rectangular but which may not have precise 90 degree angles at each corner. Furthermore, reference to these geometries includes like geometries formed of linear, substantially linear, and curved surfaces. As an example, the reference to a "triangular" shape, "triangular" includes equilateral, isosceles, scalene, right angle, acute, obtuse, equiangular, spherical and curvilinear triangles. Further still, however, the techniques provided herein are not limited to these particular classes of geometries, but could include other facet geometries. And further still, a single mesh reflector may be formed of facets having different facet geometries, for example, some region or portion of a reflector may have a facet shape of a first geometry, while another region has a facet shape of a second geometry.

As described above, antenna modeling software such as Grasp or actual far field testing may be used to identify geometries, size variations and patterns that will result in a desired reduction in grating lobe peak. Example plots are provided above showing that in some examples the present techniques may achieve a 6 dB reduction in lobe peak intensity. These techniques are not limited to that range, as even further reductions may be achieved by using modeling approximation techniques or actual testing to determine the mesh reflector variables, as will be appreciated by persons of ordinary skill in the art.

In some examples, it is desirable to have a lightweight, collapsible, and deployable mesh reflector, which may be achieved by the techniques described with reference to FIGS. 1-19. Further descriptions of these techniques are described in the co-filed and commonly-assigned U.S. application Ser. No. 11/364,458 entitled "Arbitrarily Shaped Deployable Mesh Reflectors," incorporated by reference above. That application also describes example techniques for mesh fabrication and mesh attachments that may be used with the techniques described herein to form the mesh reflectors of varying sized facets as described.

Other aspects and features of the present invention can be obtained from a study of the drawings, the disclosure, and the appended claims.

What I claim is:

1. A mesh reflector having reduced sized grating lobes to increase useful RF energy comprising: a mesh reflecting surface comprising a plurality of small mesh openings capable of reflecting radio frequency signals, wherein said mesh surface is divided into a plurality of substantially flat facets of a first parallelogram shape and varying sizes, each of the facets including a large number of the small mesh openings and being bounded by a plurality of elongate members forming a perimeter of the parallelogram shaped, varying sized facets; and a reflector frame for supporting the mesh reflecting surface.

2. The mesh reflector of claim 1, wherein the plurality of substantially flat facets of the first parallelogram shape comprises rectangular facets.

3. The mesh reflector of claim 1, wherein the mesh reflecting surface comprises a first region and a second region, wherein the facets at the first region of the reflector are smaller in size than the facets at the second region of the reflector.

4. The mesh reflector of claim 3, wherein the first region is a center region and the second region is an outer edge region.

5. The mesh reflector of claim 3, wherein the first region is an outer edge region and the second region is a center region.

6. The mesh reflector of claim 3, wherein the first region is disposed on a first side of the mesh reflector and the second region is disposed on a second side of the mesh reflector opposite the first side.

7. The mesh reflector of claim 3, wherein the facets gradually increase in size from the first region to the second region.

8. The mesh reflector of claim 3, wherein the facets increase in size form the first region to the second region in a discrete patterned manner.

9. The mesh reflector of claim 1, wherein the smallest sized facet of the mesh reflector has a first size, and wherein the variation in size of the facets over the mesh reflector is such that a lobe peak of one or more grating lobes of the mesh reflector is reduced in intensity by at least 3 dB from that of a mesh reflector having only facets of the first parallelogram shape and the first size.

10. The mesh reflector of claim 1, wherein the facets vary in size across the mesh reflector in a random manner.

11. The mesh reflector of claim 1, wherein the elongate members comprise first and second sets of elongate members, the first set of elongate members attached to said mesh reflecting surface in order to shape it by applying forces in a direction substantially perpendicular to the surface; and the second set of elongate members attached to said mesh reflecting surface and extending in different directions across said mesh reflecting surface dividing it into the plurality of substantially flat facets.

12. The mesh reflector of claim 11, wherein said second set of elongate members includes two subsets of substantially parallel elongate members extending in two different directions and having varying spacing to form the plurality of substantially flat facets of the first parallelogram shape.

13. The mesh reflector of claim 1 wherein the elongate members comprise chords.

14. A mesh reflector having reduced sized grating lobes to increase useful RF energy comprising: a mesh reflecting surface comprising a plurality of small mesh openings capable of reflecting radio frequency signals, wherein said mesh surface is divided into a plurality of substantially flat triangular facets of varying sizes, each of the facets including a large number of the small mesh openings and being bounded by a plurality of elongate members forming a perimeter of the triangular facets; and a reflector frame for supporting the mesh reflecting surface.

15. The mesh reflector of claim 14, wherein the mesh reflecting surface comprises a first region and a second region, wherein the triangular facets at the first region of the reflector are smaller in size than the triangular facets at the second region of the reflector.

16. The mesh reflector of claim 15, wherein the first region is a center region and the second region is an outer edge region.

17. The mesh reflector of claim 15, wherein the first region is an outer edge region and the second region is a center region.

18. The mesh reflector of claim 15, wherein the first region is disposed on a first side of the mesh reflector and the second region is disposed on a second side of the mesh reflector opposite the first side.

19. The mesh reflector of claim 15, wherein the triangular facets gradually increase in size from the first region to the second region.

20. The mesh reflector of claim 15, wherein the triangular facets increase in size from the first region to the second region in a discrete patterned manner.

21. The mesh reflector of claim 14 wherein the elongate members comprise chords.

22. A method of forming a mesh reflector having reduced sized grating lobes to increase useful RF energy, the method comprising: providing a reflector frame; mounting on said frame a mesh reflecting surface having a plurality of small mesh openings capable of reflecting radio frequency signals; and forming a plurality of substantially flat facets in the mesh reflecting surface utilizing a plurality of elongate members as a perimeter of each of the facets, wherein each of the plurality of substantially flat facets have a first shape which is at least one of a parallelogram and triangular, each facet includes a large number of the small mesh openings, and each facet varies in size.

23. The method of claim 22 further comprising: a first set of the elongate members being attached to said mesh reflecting surface in order to shape it by applying forces in a direction perpendicular to the surface; and a second set of the elongate members being attached to said mesh reflecting surface to extend in different directions across said mesh reflecting surface to divide it into the plurality of substantially flat facets.

24. The method of claim 22 wherein the formed plurality of substantially flat facets vary in size randomly within the mesh reflecting surface.

25. The method of claim 22, wherein the mesh reflecting surface comprises a first region and a second region, and the formed plurality of substantially flat facets vary in size gradually from the first region of the mesh reflecting surface to the second region of the mesh reflecting surface.

26. The method of claim 25, wherein the first region is a center region and the second region is an outer edge region.

27. The method of claim 25, wherein the first region is disposed on a first side of the mesh reflector and the second region is disposed on a second side of the mesh reflector opposite the first side.

28. The method of claim 22, further comprising: forming the plurality of substantially flat facets to have a rectangular shape.

29. The method of claim 22 wherein the elongate members comprise chords.

* * * * *